United States Patent [19]

Luscombe

[11] 3,954,210

[45] May 4, 1976

[54] UNLOADING AND SHUT-OFF DOOR

[76] Inventor: Randal Luscombe, R.F.D., Blackwater, Mo. 65322

[22] Filed: Oct. 15, 1974

[21] Appl. No.: 514,491

Related U.S. Application Data

[63] Continuation-in-part of Ser. No. 265,823, June 23, 1972, abandoned.

[52] U.S. Cl. ..... 222/561

[51] Int. Cl.[2] ..... B67D 3/00

[58] Field of Search ..... 222/561; 220/345, 346, 220/347, 348, 349, 351; 291/34

[56] References Cited

UNITED STATES PATENTS

| | | | |
|---|---|---|---|
| 2,549,126 | 4/1951 | Pearson | 222/561 X |
| 2,652,946 | 9/1953 | Beatty | 220/345 X |
| 3,082,705 | 3/1963 | Dorey | 222/561 X |

*Primary Examiner*—Allen N. Knowles
*Assistant Examiner*—Hadd Lane
*Attorney, Agent, or Firm*—D. A. N. Chase

[57] ABSTRACT

A door construction utilized to control the discharge of material, especially particulate material such as feed and grain, from the outlet of a receiver in which the material is being processed or stored. The structure employs a door member in the outlet which slides in a self-cleaning, inclined track formed by a pair of rails at each side margin of the member. The outer rail of each pair is in surface contact with the respective margin, whereas the inner rail is essentially in line contact with the margin and is part of a transversely U-shaped component that provides a passage along the margin which receives material that may enter the track. Such material is conveyed by gravity flow through the track passages and returned to the receiver, thereby providing the self-cleaning action to prevent the door member from freezing in the track and also preventing leakage of material when the door member is shut. Each of the passages is progressively larger in cross-sectional area from its upper to its lower end to prevent the material from caking and obstructing the passage.

5 Claims, 7 Drawing Figures

UNLOADING AND SHUT-OFF DOOR

CROSS-REFERENCE

This application is a continuation in part of my copending application, Ser. No. 265,823, filed June 23, 1972, now abandoned..

This invention relates to improvements in unloading and shut-off doors for material receivers such as feed or grain storage bins, feed mixers and the like and, in particular, to a door construction in which the closure member slides in a selfcleaning track that is resistant to clogging and which prevents the sliding member from freezing in the track.

The unloading and shut-off doors employed with various types of agricultural equipment are commonly sliding closure members in a simple track formed by spaced rails in the nature of metal strips or flanges between which the side margins of the closure member are sandwiched. Applications for doors of this type are numerous and include stationary and vehicle-mounted bins, grinder-mixers for processing feed, batch scales and grain elevator equipment in general, and hoppers and other material receivers in general in the chemical processing and construction fields as well as agricultural applications. Such receivers handle particulate material (feed, grain, ground minerals, etc.) of various sizes plus liquid ingredients in some instances, all of which tends to clog the track of the sliding door member and render it difficult to open and close. Not infrequently, the sliding door member will freeze due to the material accumulation in its track and a hammer will be required to free the door before it can be operated. The inherent inability of such doors to remain free in their tracks and easy to operate is a constant nuisance to those who operate and use equipment of this type.

It is, therefore, the primary object of the present invention to provide an unloading and shut-off door which will remain free in its track and easy to operate although constantly exposed to particulate material that will tend to clog the track and freeze the door in place.

As a corollary to the foregoing object, it is an important aim of this invention to provide a door as aforesaid having a self-cleaning track which prevents the clogging action that would otherwise occur due to the buildup of particulate material in the track structure.

Another important object of this invention is to provide a door as aforesaid wherein the self-cleaning is accomplished by a special track configuration which not only prevents material buildup, but also prevents leakage of material through the door when the latter is shut.

Still another important object of this invention is to provide a door as aforesaid wherein passages are provided along the track and the side margins of the sliding closure member, and wherein such passages are for the purpose of receiving material entering the track at the door margins and conveying such material away from the track and back into the bin or other receiver in which the material is being processed or stored.

Furthermore, it is an important object of this invention to provide a door as aforesaid wherein the track at each side margin of the closure member is formed by a pair of rails, one of which is in line contact rather than surface contact with the member to further reduce the tendency of materials to clog the track and to cause such materials to enter the passage for flow therethrough and removal from the track.

Additionally, other important objectives are to provide a track configuration resistant to caking of particulate materials therein, a configuration wherein the track components may be adjusted to control the holding force applied to the side margins of the sliding closure member, and a configuration which provides an effective seal when the door is closed.

Figure 1:
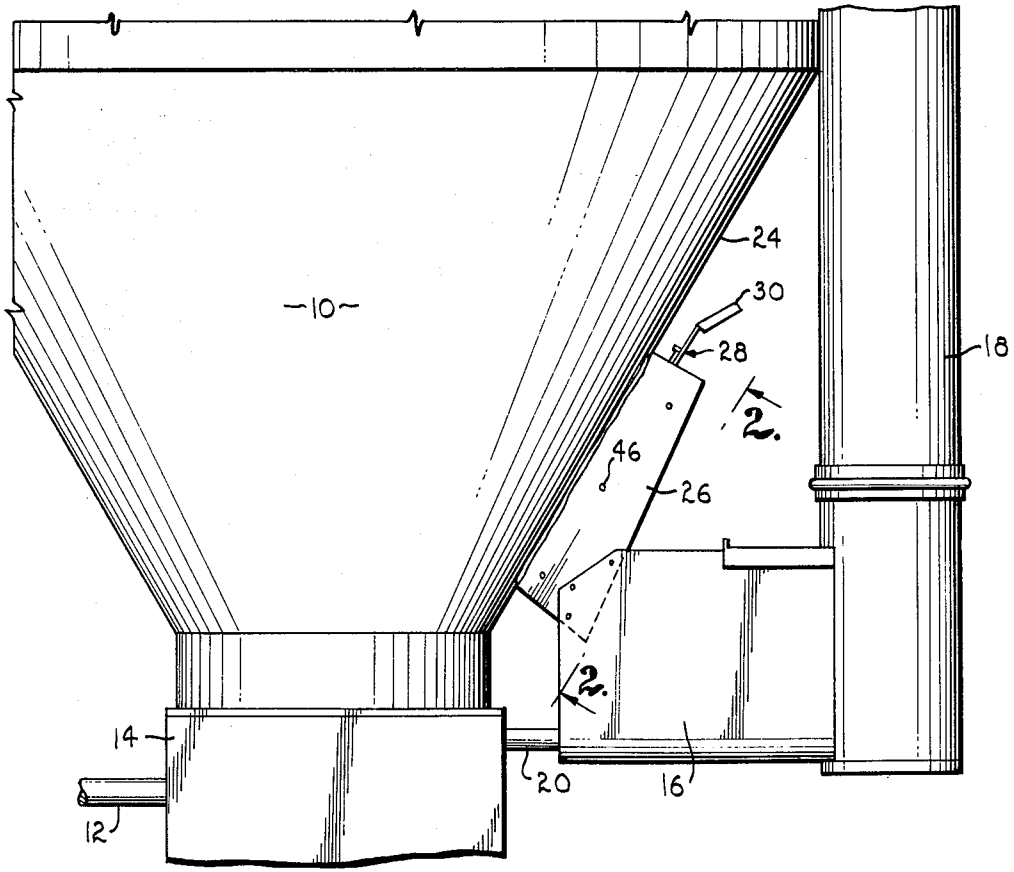
FIG. 1 is a fragmentary, side elevation of a feed mixer showing the door construction of the present invention on the outlet thereof.

Referring initially to FIG. 1, a feed mixer is illustrated having a receiver in the nature of a hopper 10 within which a mixing auger (not shown) is centrally disposed and rotates about a vertical axis. A drive shaft 12 is shown extending into the base 14 of the mixer structure and is coupled to the mixing auger at its lower end, it being understood that a suitable prime mover would be connected to the shaft 12 by a power takeoff from other equipment, for example, or by other conventional means. The outlet of the mixer discharged the mixed feed into a trough 16 where it is fed to an auger within an upright tube 18 and conveyed to a storage bin (not shown) or other point of use. A drive connection to the delivery auger in tube 18 is illustrated by the shaft 20.

Figure 3:
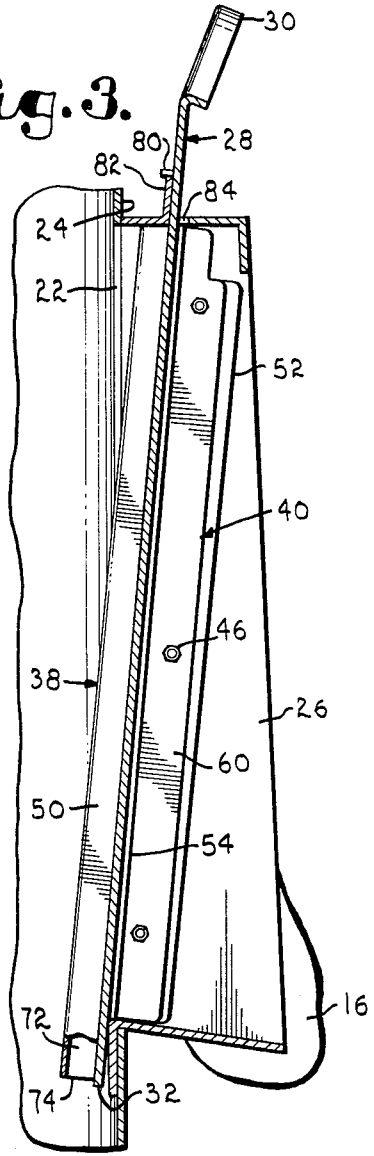
FIG. 3 is a vertical cross-sectional view taken along line 3—3 of FIG. 2.

The outlet of the mixer illustrated in FIG. 1 is formed by a rectangular opening 22 in the sidewall 24 of the hopper 10 as best seen in FIG. 3. The door construction of the present invention is mounted in the opening 22, and includes a rectangular door frame 26 surrounding the opening 22, and a track which mounts a sliding door member 28 provided with a handle 30 at its upper edge.

The door member 28 is an elongated, rectangular plate preferably of sheet metal construction and extends lengthwise at a somewhat lesser inclination than the portion of the sidewall 24 adjacent the outlet opening 22. As is clear in FIG. 1, the sidewall section 24 of the hopper 10 is of inverted, frustoconical configuration; in FIG. 3 it may be seen that the door member 28 is tipped somewhat relative to sidewall 24 so that the handle 30 is spaced therefrom but its lower edge 32 is within the hopper 10 when the door member 28 is fully closed as illustrated. The track for the member 28 is formed by a pair of elongated track components 34 and 36 secured to the left side of the door frame 26 (as viewed in FIGS. 2 and 4) and a pair of track components 38 and 40 secured to the right side of the frame 26. The two pairs of track components are identical in construction and are both mounted on the inside of the frame 26 substantially at the opening 22. The components 34 and 36 slidably receive the left longitudinal side margin 42 of the member 28, whereas the components 38 and 40 slidably receive the right longitudinal side margin 44.

A series of three nut and bolt assemblies 46 fasten the components 34, 36 and 38, 40 to the respective sides of the frame 26. Referring to components 38 to 40, the former is of transversely U-shaped configuration to present an elongated bight element 48 and a pair of longitudinal flanges 50 and 52, whereas the latter is essentially an angle member presenting a flat strip 54 in surface contact with the margin 44 of the door member 28. The flange 50 is in the inner rail of the track and is in essentially line contact with the inwardly facing surface 56 of the door member 28, and the strip 54 is the outer rail of the track engaging the outwardly facing surface 58 of the member 28. The flange 52 of the inner component 38 is wider than the rail 50 and extends outwardly into side-by-side relationship with the flange 60 of the angle component 40, the two flanges 52 and 60 being held tightly together against the door frame 26 by the nut and bolt assemblies 46. Such flanges 52 and 60 are slotted to receive the bolts, the slots being sufficiently large to permit adjustable positioning of the components 38 and 40 to set the gap between the rails 50 and 54 as desired.

Likewise, the track component 34 is of generally U-shaped configuration and has a bight element 62 and a pair of spaced flanges 64 and 66, the flange 64 presenting the inner rail of the track at that side of the door. The track component 36 is an angle member like the component 40 and presents an outer rail 68 flat against the outwardly facing surface 58 of the member 28, and a flange 70 secured to the frame 26 along with flange 66 by the nut and bolt assemblies 46.

Figure 4:
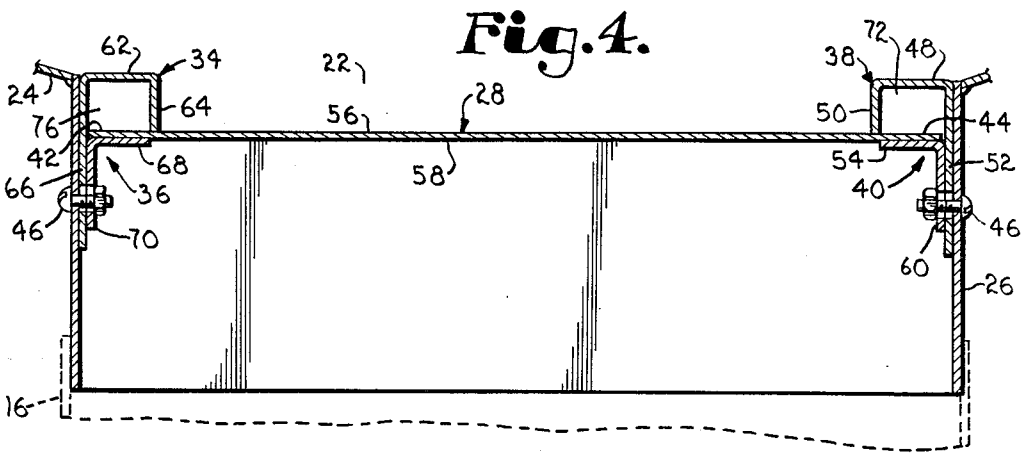
FIG. 4 is a further enlarged, cross-sectional view taken along line 4—4 of FIG. 2, the discharge trough being illustrated in broken lines.
Figure 6:
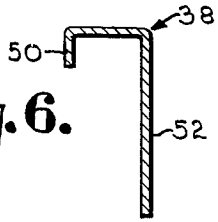
FIG. 6 is a fragmentary, cross-sectional view taken along line 6—6 of FIG. 2 and on the same scale as FIG. 4, and illustrates the cross-sectional configuration of the inner track component adjacent the upper end of the material passage.
Figure 7:
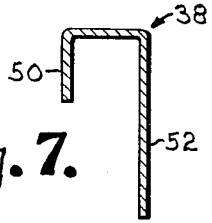
FIG. 7 is a view similar to FIG. 6 but taken along line 7—7 of FIG. 2 adjacent the lower end of the material passage.

By virtue of its U-shaped configuration, the track component 38 defines a passage 72 of rectangular cross-section as is clear in FIG. 4. The passage 72 extends the length of the component 38 and is presented by the bight element 48 and the flange 52 in cooperation with the inner rail 50. The margin 44 of the door member 28 seals the passage 72 at the front when the door is closed and, when open, the only gap is the small space between the proximal, opposed longitudinal edges of the rails 50 and 54 that would otherwise be occupied by the door member 28. As may be seen by comparing FIG. 3 with FIGS. 4, 6 and 7, the inner rail 50 is narrower at the top than at the bottom so that the cross-sectional area of the passage 72 progressively increases from its upper end to the lower end thereof. At such lower end, an opening 74 (FIG. 3) is presented which communicates the passage 72 with the interior of the hopper 10. It may be noted in FIG. 3 that the lower end of the track component 40 terminates at the bottom of the door frame 26, whereas the track component 38 extends on downwardly a short distance within the hopper sidewall 24.

Similarly, the track component 34 presents a passage 76 along the margin 42 of the door member 28. The passage 76 progressively increases in cross-sectional area as its lower end is approached, in the same manner as the passage 72 discussed above. The passage 76 is also open at its lower end and terminates within the hopper 10 just below the lower edge of the outlet opening 22.

Special attention is directed to FIG. 4 where it may be seen that the inner rails 50 and 64 are inset from the longitudinal edges of the door member 28 due to the U-shaped configuration of the components 34 and 38. These track components are preferably formed of sheet steel having a thickness of 1/16 inch, for example. Accordingly, as mentioned above, the longitudinal, outwardly facing edges of the inner rails 50 and 64 are essentially in line contact with the inwardly facing surface 56 of the door member 28. The contact is minimized, of course, since the sheet metal material is relatively thin, yet a thickness of 1/16 inch provides the track components with sufficient rigidity and durability.

In contrast to the inner rails 50 and 64, the outer rails 54 and 68 are in surface contact with the respective side margins 44 and 42 of the door member 28, and each engages an area outside of the line of contact of the opposing inner rail. As shown in FIG. 4, although the door member 28 is sandwiched between the inner and outer rails, the insetting of the inner rails 50 and 64 places their lines of contact with the door member 28 out of direct alignment with the outer rails 54 and 68 and just inside their longitudinal edges at the narrow gaps defined by each rail pair. In this manner, material flowing from the outlet opening 22 does not have as great a tendency to flow into the gaps when exposed by the opening of the door member 28, and freedom of sliding movement of the member 28 is enhanced by the misalignment of the rails at each margin.

Figure 2:
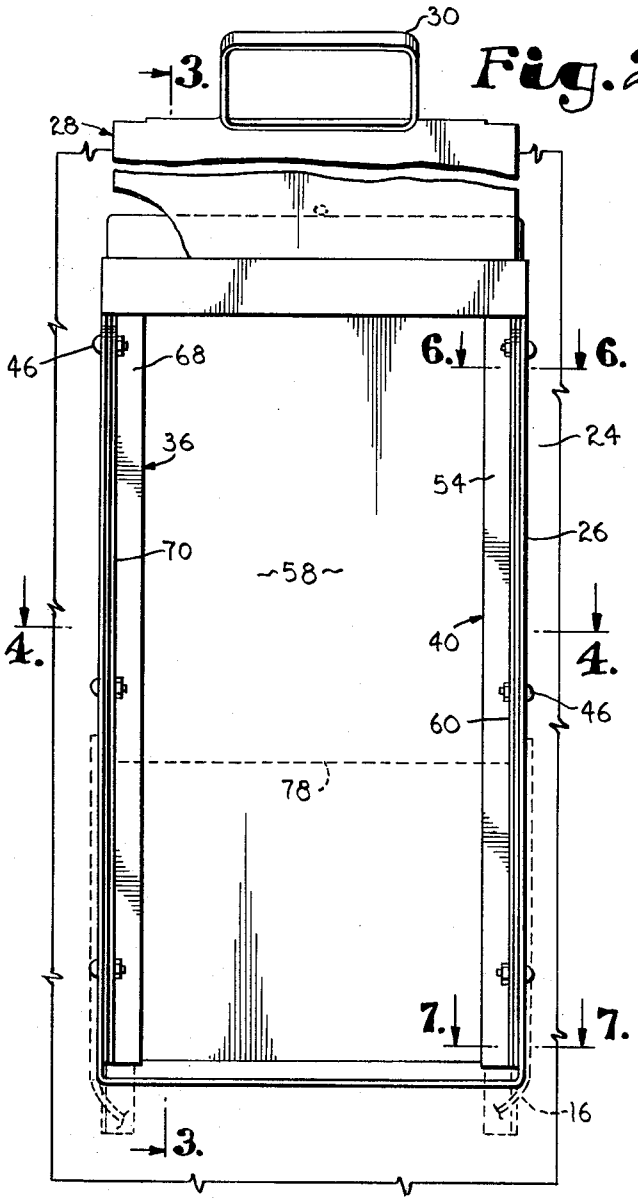
FIG. 2 is a fragmentary, enlarged view taken along line 2—2 of FIG. 1 and showing the door construction of the present invention in front elevation, the discharge trough being illustrated in broken lines.

The open position of the door member 28 is illustrated in FIG. 2 by the horizontal broken line 78 which represents the level of the lower edge of the member 28 when it is raised. The open position may be varied in accordance with the flow desired so as to provide a controllable delivery gate, the level illustrated by line 78 merely being illustrative of the fully open position for the particular discharge trough 16 shown. Movement of the door member 28 to its closed position is limited by a stop 80 on the member 28 just beneath the handle 30 which engages the upper edge of a flange 82 projecting from the top of the door frame 26 at a slot 84 in the frame 26 through which the member 28 extends.

Figure 5:
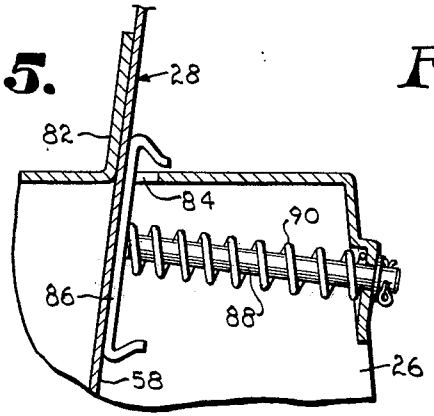
FIG. 5 is a detail view showing a modification of the door construction to include a spring-loaded holding device.

A holding device is illustrated in FIG. 5 as a modification to the door construction which is employed for the purpose of positively maintaining the door member 28 in the desired open position so that it cannot slide shut when released. A plate element 86 is welded to one end of a stem 88 to form a friction head thereon in engagement with the outwardly facing surface 58 of the member 28. The opposite end of the stem 88 is retained in the door frame 26 and a coil spring 90 is in compression on the stem 88 to bias the plate element 86 into tight frictional contact with the surface 58. In this manner, resistance is added to sliding movement of the door member 28.

In the utilization of the present invention, the gap between each pair of rails 50, 54 and 64, 68 is adjusted to provide the desired degree of freedom of sliding movement of the door member 28 in the track. The nut and bolt assemblies 46 are tightened to secure the rails in the desired spaced relationship; it should be understood that the rail spacing shown in FIG. 4 is the minium spacing since the outer rails 54 and 68 are in continuous surface contact with the margins 44 and 42, and the inner rails 50 and 64 are likewise in continuous line contact with such margins. In practice, somewhat wider gaps between the rail pairs may be desired so that the door member 28 will slide freely in the track without a tendency to bind.

It may be appreciated that the passages 72 and 76 are closed on the hopper side of the outlet opening 22 by the respective bight elements 48 and 62 so that the material within the hopper 10 cannot readily enter the passages. In order to enter between the rails where such material could clog the track if not removed, the material must flow outwardly around the inner rails 50 and 64 and into the passages via the gaps between the inner and outer rails at the side margins 42 and 44. This can occur if the door member 28 fits loosely in the track, and may also occur when the door member is raised to its open position and material is permitted to discharge through the outlet opening 22 (although such flow into the gaps is minimized by the inset inner rails 50 and 64). In any event, when material enters between the rails it is immediately received by the passages 72 and 76 and flows by gravity back into the hopper 10. In the mixer illustrated in FIG. 1, the material is returned to a region adjacent the bottom of the mixing auger at the base of the hopper 10 and is remixed with the material in the hopper. Since each of the passages 72 and 76 progressively increases in crosssectional area from its upper end to its lower end, caking of particulate material within the passages is unlikely and free gravity flow is facilitated to the discharge openings presented at the lower ends of the passages (opening 74 at the lower end of passage 72 is shown in FIG. 3).

The self-cleaning action just described is enhanced by the particular arrangement of the inner rails 50 and 64 which are in line contact with the inwardly facing surface 56 of the door member 28. Since there is minimal contact between such inner rails and the door surface facing them, it is difficult for material to build up between the inner rails and the door surface plus the passages 72 and 76 effect immediate removal of material that would otherwise tend to become clogged.

Furthermore, the track arrangement of the present invention provides an effective seal when the door member 28 is closed since the outer rails 54 and 68 are in surface contact with the door margins. Should any material leak by the inner rails 50 and 64, it merely flows into the passages 72 and 76 and is returned to the hopper with no loss.

Having thus described the invention, what is claimed as new and desired to be secured by Letters Patent is:

1. In a receiver having an outlet from which material in the receiver is discharged, an unloading and shut-off door comprising:

a door frame surrounding said outlet;

a reciprocable door member having a pair of opposed side margins and presenting opposed, inwardly and outwardly facing surface; and track structure mounting said door member in said frame for sliding movement in the track structure between a closed position sealing said outlet and an open position permitting discharge of said material therefrom, said structure including an inner rail and an outer rail presenting a pair thereof at each of said margins of the door member receiving the respective margin therebetween and engageable with corresponding surfaces of said door member, each pair of rails extending at an angle to the horizontal and having means cooperating with the inner rail to define a passage along the rails and the respective margin for receiving material entering the track structure at said margin and conveying such material away from the track structure by gravity flow through said passage, whereby to provide a self-cleaning door track to prevent the door member from freezing in either position, each pair of rails including an elongated, transversely generally U-shaped track component and an elongated, flat track component presenting said outer rail, said U-shaped component having a bight and a pair of spaced longitudinal flanges, one of said flanges presenting said inner rail and being inset from the edge of the door member defined by the respective margin and in engagement with said inwardly facing surface exclusively at a line of contact therewith extending generally along the path of sliding movement of said door member, said flat component engaging said outwardly facing surface over a substantial area of the respective margin outside of said line of contact, said bight and the other of said flanges of the U-shaped component presenting said cooperating means, each pair of rails having an opening communicating the associated passage with said receiver at the lower end of the passage, whereby material entering the track structure at the side margins of the door member returns to the receiver through said passages to prevent leakage when the door member is in its closed position.

2. The door as claimed in claim 1, wherein each of said passages progressively increases in cross-sectional area from its upper portion to said opening at the lower end thereof.

3. The door as claimed in claim 1, wherein said track structure further includes adjustable means securing said pairs of rails to said frame for relative movement of said U-shaped and flat components toward and away from each other to selected positions that determine the holding force applied to said margins of the door member.

4. The door as claimed in claim 1, wherein is provided a holding device on said frame for maintaining said door member in either of said positions unless an overriding force is applied to slide the door member in the track structure, said device including a plate element engaging said outwardly facing surface and yieldable means biasing said plate element toward said outwardly facing surface to hold the element in frictional contact therewith.

5. In a receiver having an outlet from which material in the receiver is discharged, an unloading and shut-off door comprising:

a door frame surrounding said outlet;

a reciprocable door member having a pair of opposed side margins and presenting opposed, inwardly and outwardly facing surfaces; and track structure mounting said door member in said frame for sliding movement in the track structure between a closed position sealing said outlet and an open position permitting discharge of said material therefrom, said structure including an inner rail and an outer rail presenting a pair thereof at each of said margins of the door member receiving the respective margin therebetween and engageable with corresponding surfaces of said door member, each pair of rails extending at an angle to the horizontal and having means cooperating with the inner rail to define a passage along the rails and the respective margin for receiving material entering the track structure at said margin and conveying such material away from the track structure by gravity flow through said passage, whereby to provide a self-cleaning door track to prevent the door member from freezing in either position, each pair of rails including an elongated, transversely generally U-shaped track component and an elongated, flat track component presenting said outer rail, said U-shaped component having a bight and a pair of spaced longitudinal flanges, one of said flanges presenting said inner rail and being inset from the edge of the door member defined by the respective margin and in engagement with said inwardly facing surface exclusively at a line of contact therewith extending generally along the path of sliding movement of said door member, said flat component engaging said outwardly facing surface along the respective margin.

said bight and the other of said flanges of the U-shaped component of each pair of rails presenting said cooperating means and closing the respective passage against ingress of said material except that which enters between the rails and door member.

* * * * *

UNITED STATES PATENT OFFICE

CERTIFICATE OF CORRECTION

PATENT NO. : 3,954,210

DATED : May 4, 1976

INVENTOR(S) : RANDAL LUSCOMBE

It is certified that error appears in the above-identified patent and that said Letters Patent are hereby corrected as shown below:

Column 5, Claim 1, line 58, change "surface" to --surfaces--.

Signed and Sealed this

Thirteenth Day of July 1976

[SEAL]

*Attest:*

RUTH C. MASON
*Attesting Officer*

C. MARSHALL DANN
*Commissioner of Patents and Trademarks*